US009859599B2

(12) United States Patent
Guyette et al.

(10) Patent No.: US 9,859,599 B2
(45) Date of Patent: Jan. 2, 2018

(54) BANDSTOP FILTERS WITH MINIMUM THROUGH-LINE LENGTH

(71) Applicant: The United States of America, as represented by the Secretary of the Navy, Washington, DC (US)

(72) Inventors: Andrew C. Guyette, Alexandria, VA (US); Eric J. Naglich, Alexandria, VA (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 117 days.

(21) Appl. No.: 15/073,292

(22) Filed: Mar. 17, 2016

(65) Prior Publication Data

US 2016/0276724 A1 Sep. 22, 2016

Related U.S. Application Data

(60) Provisional application No. 62/134,457, filed on Mar. 17, 2015, provisional application No. 62/309,191, filed on Mar. 16, 2016.

(51) Int. Cl.
*H01P 1/203* (2006.01)

(52) U.S. Cl.
CPC ..... *H01P 1/203* (2013.01); *H01P 1/2039* (2013.01)

(58) Field of Classification Search
CPC ..... H01P 1/203; H01P 1/2039
USPC ..... 333/204
See application file for complete search history.

(56) References Cited

U.S. PATENT DOCUMENTS

2008/0100401 A1* 5/2008 Cho ..... H01P 1/20345 333/204
2010/0117766 A1* 5/2010 Grondahl ..... H01P 7/082 333/204

OTHER PUBLICATIONS

Nizam et al., "Design of a Modified L-Shaped Bandstop Filter for UWB Applications", 2009 SBMO/IEEE MTT-S International Microwave and Optoelectronics Conference (IMOC), pp. 177-182.*

* cited by examiner

*Primary Examiner* — Benny Lee
*Assistant Examiner* — Hafizur Rahman
(74) *Attorney, Agent, or Firm* — US Naval Research Laboratory; William P. Ladd

(57) ABSTRACT

Systems and methods are provided for creating higher order microwave bandstop filters with total through-line length of significantly less than one-quarter wavelength at the filter center frequency. The mixed electric and magnetic field coupling bandstop filter topologies provided by embodiments of the present disclosure can be used to reduce the size, weight, and throughline insertion loss of microwave bandstop filters. In an embodiment, if the relative field strengths are intelligently designed for each coupling structure, effective phase offsets can be produced between resonators along the through line. These phase offsets can be used to absorb some or all of the length of the λ/4 inverters between resonators.

20 Claims, 11 Drawing Sheets

BANDSTOP FILTERS WITH MINIMUM THROUGH-LINE LENGTH

CROSS REFERENCE TO RELATED APPLICATIONS

This application claims the benefit of U.S. Provisional Patent Application No. 62/134,457, filed on Mar. 17, 2015, and U.S. Provisional Patent Application No. 62/309,191, filed on Mar. 16, 2016, both of which are incorporated by reference herein their entireties.

FIELD OF THE DISCLOSURE

This disclosure relates to filters, including bandpass filters.

BACKGROUND

Microwave bandstop filters can be used to reflect or absorb unwanted signals in a microwave system. These unwanted signals can originate from co-site or externally generated interference as well as nonlinear components under high-power excitation in the system. For example, a traditional microwave bandstop filter can be composed of resonators coupled to a through line with quarter-wavelength admittance inverters between each resonator. This bandstop filter topology can produce a symmetric notch frequency response and meet a wide variety of practical specifications. However, when the traditional microwave bandstop filter topology is used for high-order filters, the total through-line length becomes long.

A long through-line leads to higher passband insertion loss, increased circuit size and weight, and larger dispersive effects. In addition, the through-line lengths are difficult to tune in production environments yet have appreciable effects on the frequency response of the filter. Thus, conventional bandpass filters have undesirably large passband insertion loss, size, and weight.

BRIEF DESCRIPTION OF THE DRAWINGS/FIGURES

The accompanying drawings, which are incorporated in and constitute part of the specification, illustrate embodiments of the disclosure and, together with the general description given above and the detailed descriptions of embodiments given below, serve to explain the principles of the present disclosure. In the drawings.

Figure 1A:
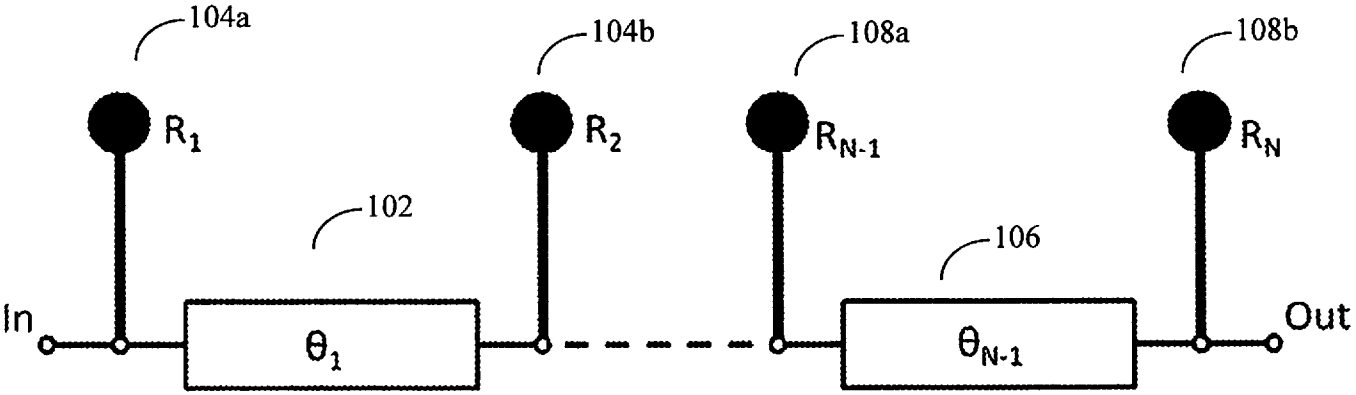
FIG. 1A is a diagram showing an exemplary in-line microwave bandstop circuit topology comprising a transmission line to which a number of electromagnetic resonators are coupled in accordance with an embodiment of the present disclosure.

Features and advantages of the present disclosure will become more apparent from the detailed description set forth below when taken in conjunction with the drawings, in which like reference characters identify corresponding elements throughout. In the drawings, like reference numbers generally indicate identical, functionally similar, and/or structurally similar elements. The drawing in which an element first appears is indicated by the leftmost digit(s) in the corresponding reference number.

DETAILED DESCRIPTION

In the following description, numerous specific details are set forth to provide a thorough understanding of the disclosure. However, it will be apparent to those skilled in the art that the disclosure, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring aspects of the disclosure.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

For purposes of this discussion, the term "module" shall be understood to include one of software, or firmware, or hardware (such as circuits, microchips, processors, or devices, or any combination thereof), or any combination thereof. In addition, it will be understood that each module can include one, or more than one, component within an actual device, and each component that forms a part of the described module can function either cooperatively or independently of any other component forming a part of the module. Conversely, multiple modules described herein can represent a single component within an actual device. Further, components within a module can be in a single device or distributed among multiple devices in a wired or wireless manner.

1. Overview

Embodiments of the present disclosure provide systems and methods for implementing bandstop filters using minimum through-line lengths between coupled resonators. For example, conventional microwave bandstop filters with λ/4 inverters between each resonator usually assume that the coupling structures between the through-line and the resonators all implement coupling with either electric field, magnetic field, or the same relative mixture of electric and magnetic field. Embodiments of the present disclosure use mixed electric and magnetic field coupling to reduce physical length between coupled lines.

In an embodiment, a bandstop filter in accordance with an embodiment of the present disclosure comprises a number of resonators coupled along a transmission line, with a ratio of electric to magnetic coupling of each resonator set such that that physical length between coupled lines is minimized. For example, in an embodiment, if the relative field strengths are intelligently designed for each coupling structure, effective phase offsets can be produced between resonators along the through line. These phase offsets can be used to absorb some or all of the length of the λ/4 inverters between resonators. Thus, the bandstop filter topologies provided by embodiments of the present disclosure can be used to reduce the size, weight, and throughline insertion loss of microwave bandstop filters.

2. Bandstop Filters

Bandstop filters can be used in microwave systems to excise unwanted signals. FIG. 1A is a diagram showing an exemplary in-line microwave bandstop circuit topology comprising a transmission line 102 to which a number of electromagnetic resonators 104 are coupled. The electrical length between adjacent resonators is typically close to a quarter wavelength, defined at the center frequency of the filter. The required transmission line lengths in the circuit topology of FIG. 1A limit passband insertion loss and place a lower limit on size and weight. As shown in FIG. 1A, any number of additional bandstop filters 106 and electromagnetic resonators 108 can be coupled to the circuit.

An exemplary bandstop filter in accordance with an embodiment of the present disclosure comprises a number of resonators coupled along a transmission line, with the ratio of electric to magnetic coupling of each resonator set such that the physical length between coupled resonators is minimized. This approach can be applied to both in-line bandstop topologies as well as other topologies, including reflection-mode.

3. Reflection Mode Topology

Figure 1B:
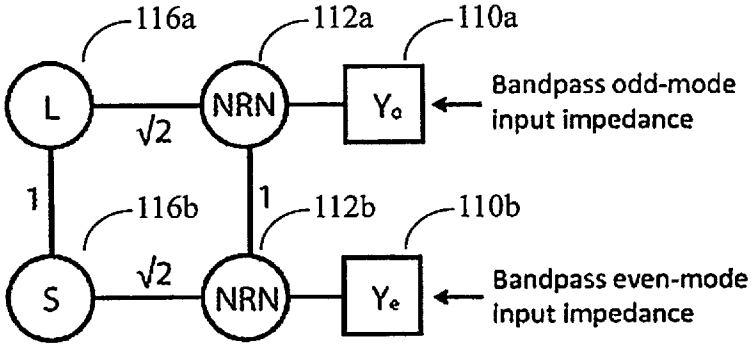
FIG. 1B is a diagram of a circuit that implement the even- and odd-mode impedances of a bandpass filter designed in accordance with an embodiment of the present disclosure.

A reflection-mode bandstop filter can be constructed by first designing a prototype bandpass filter with a reflection coefficient that is equivalent to the transmission coefficient of the desired bandstop filter. FIG. 1B is a diagram of a circuit that implements the even- and odd-mode impedances of a bandpass filter designed in accordance with an embodiment of the present disclosure. In FIG. 1B, even- and odd-mode impedances 110 are connected to two adjacent ports 112 of a four-port hybrid circuit. The remaining two ports 116 of the hybrid circuit are used as source and load ports. The combined circuit retains the even-mode impedance of the prototype bandpass filter but inverts the odd-mode impedance. When the odd-mode impedance of any linear network is inverted, the reflection coefficient becomes the transmission coefficient and vice-versa. Therefore, since the initial network was a bandpass filter, a bandstop response is produced.

A significant advantage of reflection-mode topology is that only two resonators are required to be coupled to the through-line regardless of the filter order. For example, in an exemplary fifth-order bandstop filter in accordance with an embodiment of the present disclosure, only two resonators are directly coupled to the through-line. Such a topology allows for minimum through-line length in planar technologies like stripline because a resonator can be placed on both sides of the through-line at the same point. In a fifth-order in-line topology, all five resonators would be coupled to the through line. However, even in three dimensional circuit topologies, coupling five resonators to the through-line at the same point would be difficult or impractical, resulting in a need to lengthen the through-line.

4. Bandstop Filters With Minimum Through-Line Length

A conventional microwave bandstop filter with λ/4 inverters between each resonator assumes that the coupling structures between the through-line and the resonators all implement coupling with either electric field, magnetic field, or the same relative mixture of electric and magnetic field. A bandstop filter in accordance with an embodiment of the present disclosure uses mixed electric and magnetic field coupling to reduce physical length between coupled lines. In an embodiment, if the relative field strengths are intelligently designed for each coupling structure, effective phase offsets can be produced between resonators along the through line. These phase offsets can be used to absorb some or all of the length of the λ/4 inverters between resonators. This concept is illustrated in FIG. 2A.

Figure 2A:
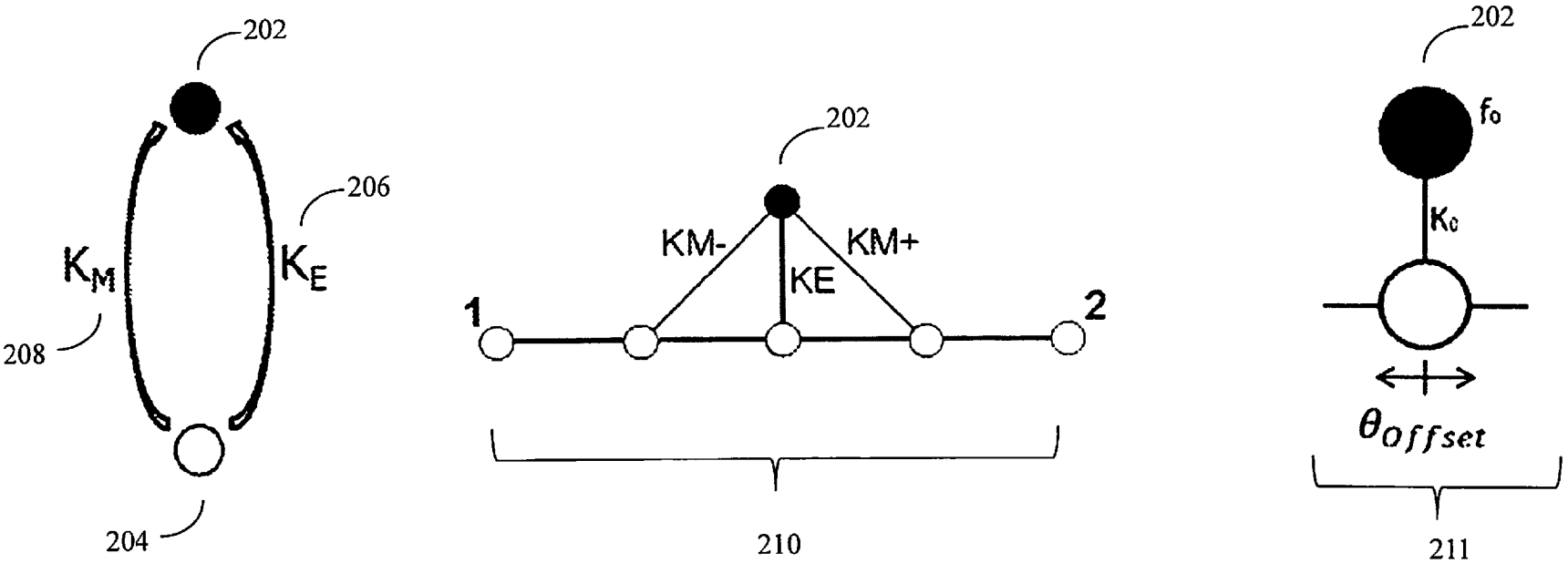
FIG. 2A is a diagram showing a resonator coupled to a node with a mixture of both electric and magnetic coupling (mixed coupling) in accordance with an embodiment of the present disclosure.

FIG. 2A is a diagram showing a resonator 202 coupled to a node 204 with a mixture of both electric 206 and magnetic 208 coupling (mixed coupling). FIG. 2A further shows that this point can be thought of as 360 degrees of electrical phase over zero physical length. FIG. 2A also shows an equivalent circuit 210 for this mixed coupling circuit based on an expansion 210 of node 204 to 360-degree phase length using 4 admittance inverters matched to the port impedance. The electric and magnetic couplings in FIG. 2A are represented by admittance inverters KE and KM+/−, respectively. The point in FIG. 2A couples to resonator 202 with negative magnetic, positive electric, and positive magnetic coupling, where negative and positive values are assigned to represent a 180 degree phase shift between two coupling values of similar type. The composite phase offset due to multiple types of coupling between a single node and a resonator can be reduced to equivalent circuit 211. Thus, equivalent circuit 211 is a representation of the node in equivalent circuit 210 as a phase offset dependent on E and M coupling. In equivalent circuit 211, $K_0=\sqrt{(K_E^2+K_M^2)}$ and $$\theta_{offset} = \pm\frac{1}{2}\mathrm{Arg}\left(\frac{2K_E}{K_E - jK_M} - 1\right),$$

where the sign of $\theta_{offset}$ depends on the relative orientation of magnetic coupling. In an embodiment, these equations can be implemented in a fourth-order minimum through length bandstop filter design, which is illustrated in FIG. 2B.

Figure 2B:
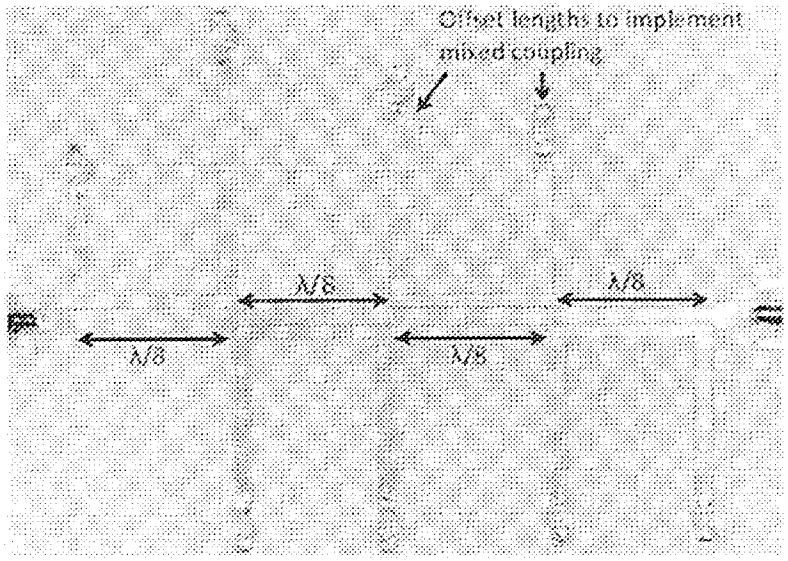
FIG. 2B is a diagram showing a photograph of an exemplary filter using mixed electric and magnetic field coupling to resonators along a through line that implements a fourth-order bandstop filter design in accordance with an embodiment of the present disclosure.

FIG. 2B is a diagram showing a photograph of an exemplary filter using mixed electric and magnetic field coupling to resonators along a through line that implements a fourth-order bandstop filter design in accordance with an embodiment of the present disclosure. In FIG. 2B, each resonator is coupled to the through line over a λ/8 physical length of line and implements a λ/8 electrical shift of the coupling reference plane between it and the next resonator through the use of appropriately designed mixed coupling. In FIG. 2B, the λ/8 physical coupling section for each resonator is followed directly by the λ/8 physical coupling section for the next resonator, so the entire length of the through line is coupled to a resonator. This is possible regardless of the length of the physical coupling section required for the desired coupling values if appropriately-designed mixed coupling is used. The result is a minimum-length design for the implemented fabrication technology and coupling values. With the combination of the λ/8 phase shifts due to the physical lengths of the coupling sections and the λ/8 electrical $\theta_{offset}$ shifts of the coupling reference planes between each pair of resonators, a composite λ/4 inverter exists between each pair of resonators despite there being only λ/8 of physical through line between each resonator.

While this technique enables an improvement over conventional designs that have a total through-line length of N*λ/4, where N is the order of the filter, the total through-line length, N*Lc, where Lc is the length of the coupling section between the through line and each resonator, can still be significant for high-order filters. The combination of reflection-mode circuit techniques and minimum-through-line-length bandstop filter theory can produce bandstop filter designs with total throughline length equal to only the length of a single coupling section, Lc, regardless of filter order. Therefore, the total through-line length becomes only a function of the desired coupling values and fabrication technology tolerances, not filter order, and it can be much shorter than λ/4 for many filter specifications. For high-order filters, dramatic reductions of total length are possible.

Figure 3:
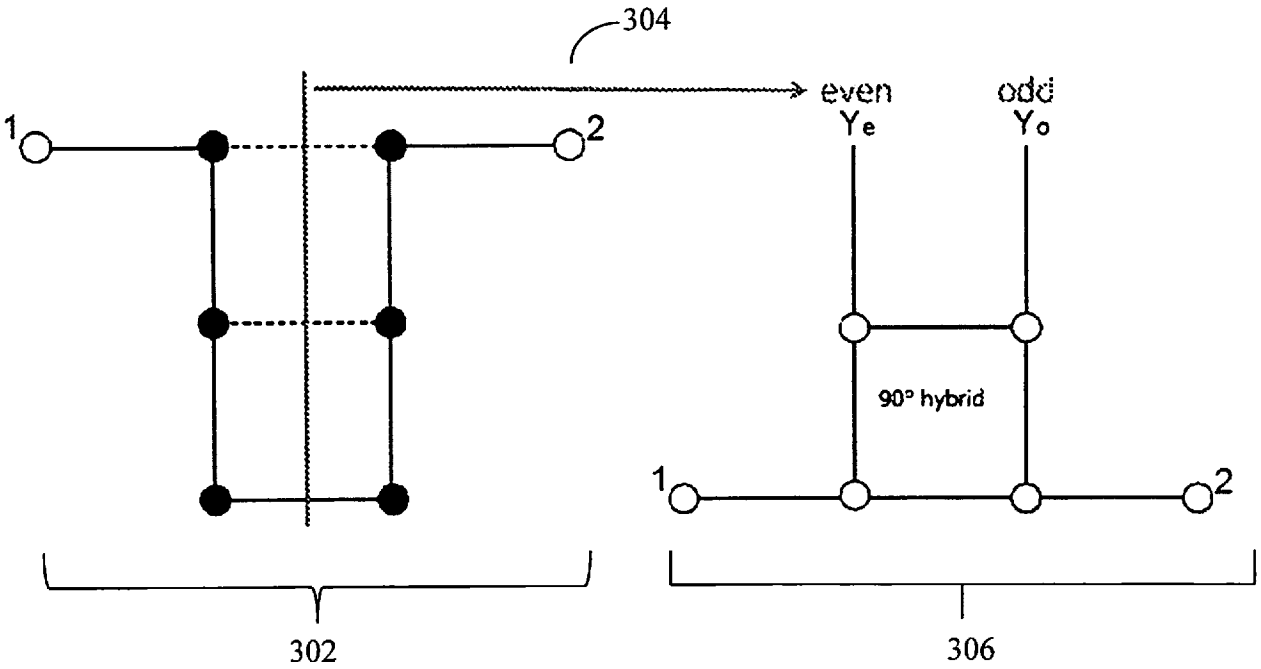
FIG. 3 is a diagram showing an example transformation of an elliptic bandpass filter to a highly selective bandstop filter in accordance with an embodiment of the present disclosure.

Reflection-mode topology can be used to interchange the reflection and transmission responses of a circuit network by placing the network's even and odd mode impedances at the correct ports of the reflection-mode structure. FIG. 3 is a diagram showing an example transformation of an elliptic bandpass filter to a highly selective bandstop filter. Elliptic bandpass filters are known for the maximum selectivity that they provide, and embodiments of the present disclosure can use that selectivity in a bandstop mode. In FIG. 3, elliptic bandpass topology 302 is transformed 304 to reflection-mode bandstop topology 306. The 90-degree hybrid in the reflection-mode bandstop topology 306 shown in FIG. 3 is classically implemented by four quarter wavelength transmission lines of varying characteristic impedance. However, when used in conjunction with an embodiment of the present disclosure, it can be reduced to a single physical point when the correct phase and strength of electromagnetic coupling values are used, as shown in FIG. 2A.

Figure 4:
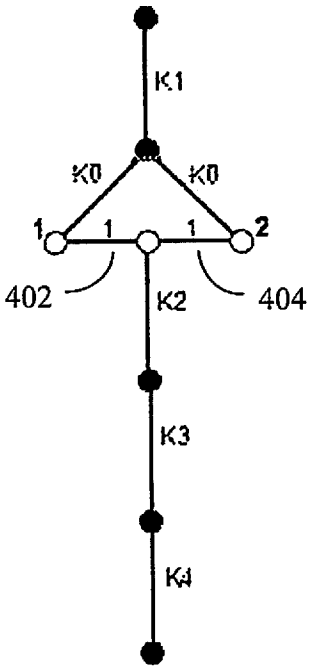
FIG. 4 is a diagram showing a zero-length, phase-expanded point that involves two couplings to one resonator and one coupling to another resonator in accordance with an embodiment of the present disclosure.

The phase-expanded but zero-length view of a point along a through line shown in FIG. 2A can be used to understand how the 90 degree hybrid in the reflection-mode bandstop prototype in accordance with an embodiment of the present disclosure collapses into a single point. FIG. 4 is a diagram showing a zero-length, phase-expanded point that involves two couplings to one resonator and one coupling to another resonator. The two couplings to the same resonator have the same phase and are of the same type because the couplings that are represented by "1" 402 and "−1" 404 in FIG. 4 are separated by 360 degrees of phase length. The coupling to the resonator below the hybrid equivalent circuit is of the opposite type because it is separated from the other two couplings by 90 and 270 degrees.

5. Second Order Example

Figure 5:
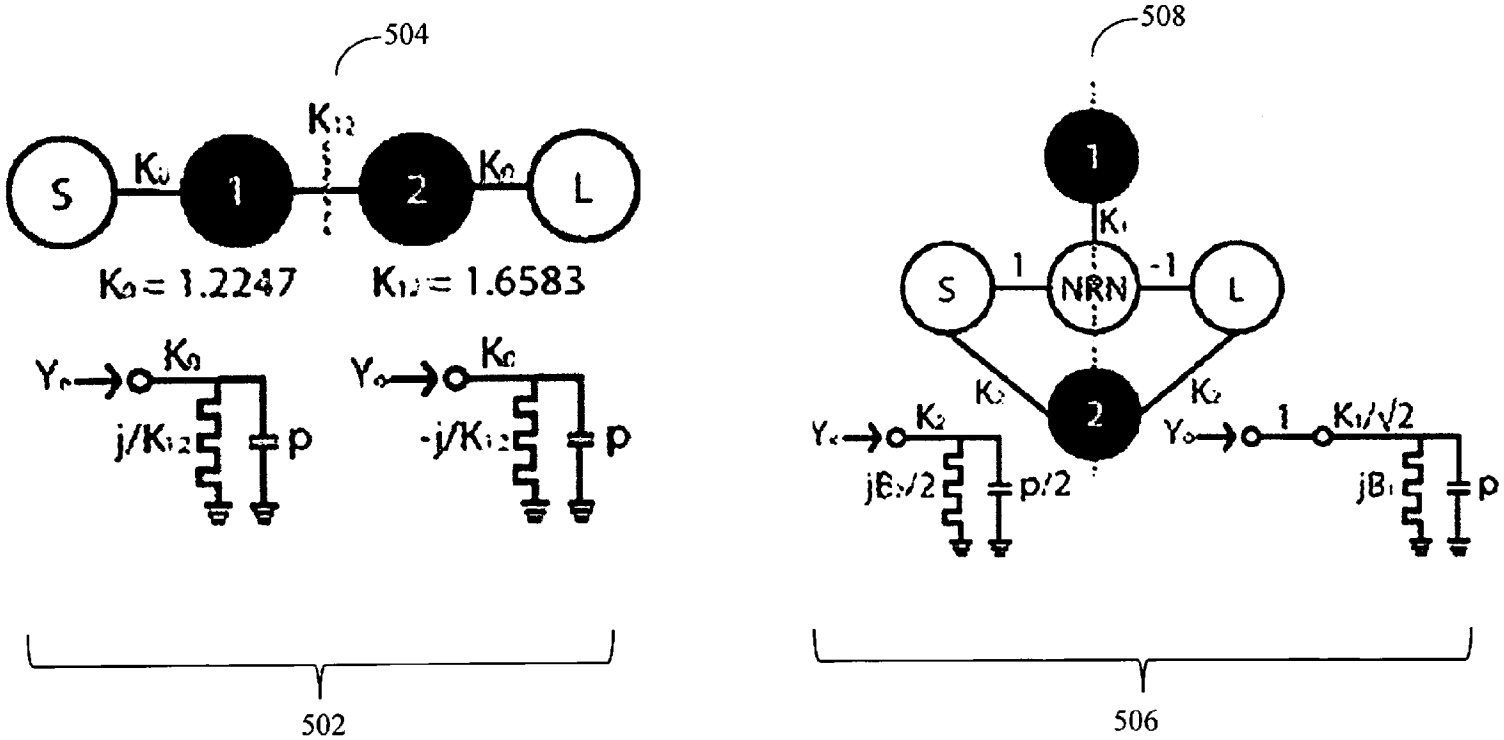
FIG. 5 is a coupling-routing diagram for a prototype lowpass filter in accordance with an embodiment of the present disclosure.

In an embodiment, the even and odd-mode admittances of a prototype lowpass filter can be determined and, the proposed reflection-mode topology can be used to implement a prototype highpass filter with a transmission coefficient equal to the reflection coefficient of the lowpass prototype and vice-versa. The highpass prototype can be transformed to produce a bandstop response using standard circuit techniques. In this example, a second-order, 20 dB equi-ripple Chebychev lowpass filter prototype will be used as the starting point. However, any lowpass prototype filter can be used for the design procedure. FIG. 5 is a coupling-routing diagram 502 for the prototype lowpass filter. The dashed line through the $K_{12}$ coupling 504 is the symmetry plane used for even-odd mode analysis, and the even- and odd-mode subcircuits can also be seen in FIG. 5. For the even mode, the $K_{12}$ coupling becomes an open-circuited λ/8 length of line with a characteristic impedance of $K_{12}$, and the input admittance is given by $Y_e=K_0^2/(p+j/K_{12})$, where j is the square root of −1, and p is the frequency variable jω. For the odd mode, the $K_{12}$ coupling becomes a shortcircuited λ/8 length of line with a characteristic impedance of $K_{12}$, and the odd-mode input admittance is given by $Y_o=.K_0^2/(p-j/K_{12})$. The reflection and transmission coefficients of the network can be found using the equations $S_{11}=(1-Y_eY_o)/((1+Y_e)(1+Y_o))$ and $S_{21}=(Y_o-Y_e)/((1+Y_e)(1+Y_o))$.

FIG. 5 also shows a 2-pole version 506 of the proposed reflection mode topology in with a dashed line 508 that indicates the plane of symmetry for even-odd mode analysis. It is important to note that the lower path through the resonator is symmetric about the dashed line, while the upper path is antisymmetric about the dashed line due to the opposite signs of the unity-magnitude inverters. An antisymmetric path will have opposite terminations in even-odd mode analysis relative to the symmetric case. For example, analysis of the even mode will use short circuit terminations in the asymmetric path. For the even mode, the antisymmetric path is shorted to ground, and the even-mode input admittance is given by $Y_e=K_2^2/(0.5(p+jB_2))$, where $B_2$ is a frequency-invariant suseceptance that manifests as a shift of the center frequency of resonator 2. Note that the $K_2$ couplings to the source and load are in-phase due to the 360 degree phase shift between the source and load ports.

For the odd mode, the lower path through resonator 2 is shorted to ground. In an embodiment, the even mode admittances have the same form; however, the forms of the odd mode admittances are inverses of each other. Therefore, in an embodiment, the reflection-mode topology can produce a highpass response with a transmission coefficient equal to the lowpass prototype's reflection coefficient.

Comparing the input admittances for FIGS. 2B and 5, it can be seen that the even mode admittances have the same form. However, the forms of the odd mode admittances are inverses of each other. Therefore, the reflection-mode topology can produce a highpass response with a transmission coefficient equal to the lowpass reflection coefficient if $K_1$, $K_2$, $B_1$, and $B_2$ are designed properly. Solving for the desired quantities yields $B_1=1/K_{12}$, $K_1=\sqrt{2}K_0$, $B_2=-1/K_{12}$, and $K_2=K_0/\sqrt{2}$.

If this 2-pole highpass filter was translated into a physical bandstop filter design, the total through-line length could be limited to only that which is needed to obtain the desired magnitudes of $K_1$ and $K_2$ if $K_1$ and $K_2$ use the proper combination of electric and magnetic coupling such that their offset values produce an intrinsic phase shift that makes the total shift equal to an odd multiple of $\lambda/4$. Depending on the design bandwidth, manufacturing technology, and characteristic impedance values, the amount of $\lambda/4$ shift required to be obtained from a physical length of transmission line can be very small.

6. Fifth Order Example

Figure 6A:
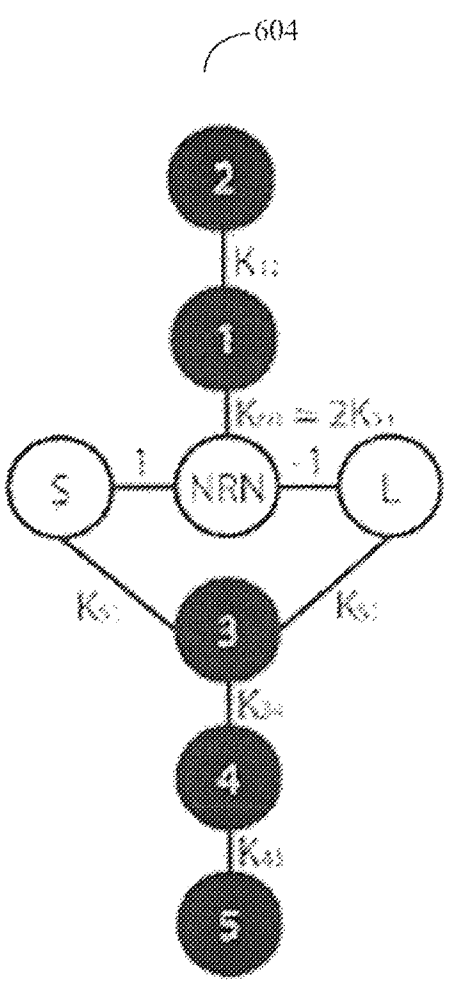
FIG. 6A is a diagram showing a coupling-routing diagram of a fifth-order bandpass filter in accordance with an embodiment of the present disclosure.

While the example shown in. the previous section could reduce the total through-line length of a second-order filter to the length of one coupling section, the proposed bandstop filter concept is especially beneficial in high-order bandstop filter designs. The through-line length does not increase beyond the length needed to couple to the first two resonators of the filter as the filter order grows. Therefore, high-order bandstop filters can be made with total through-line length equal to the length of one coupling section. FIG. 6A is a diagram showing the coupling-routing diagram 602 of a fifth-order bandpass filter.

Figure 6A:
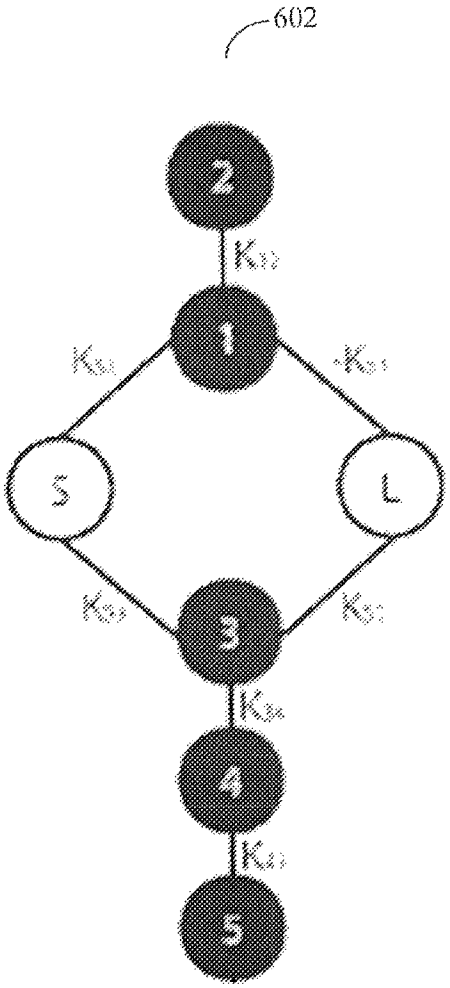
Figure 6B:
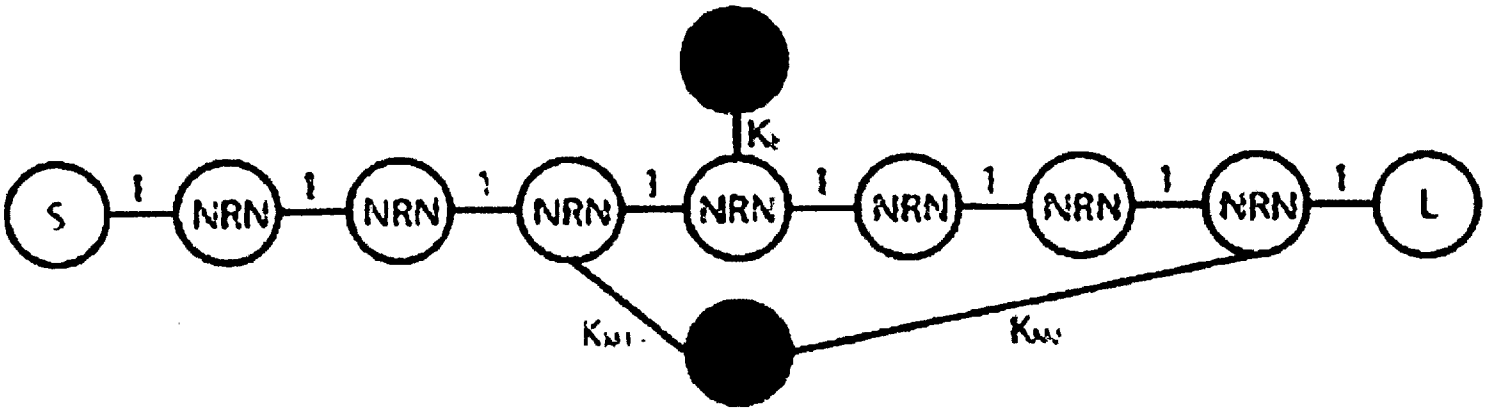
FIG. 6B is a diagram showing an exemplary expansion based on the source and load nodes of the coupling routing diagram of FIG. 6A that more clearly shows the phase relationships between the coupling values in accordance with an embodiment of the present disclosure.

Using the same even and odd-mode analysis procedure shown in the second-order example, the even- and odd-mode admittances of the fifth order bandpass filter can be found and set equal to the even and odd-mode admittances of the fifth-order reflection-mode bandstop topology 604. The result is a 30-dB equi-ripple bandstop response with four reflection zeros. This response was used as a target specification to design and fabricate a suspended-stripline prototype circuit for verification. In FIG. 6, resonators 1 and 3 are coupled to the through line. To realize the bandstop topology in FIG. 6 with the shortest possible through line, a physical coupling topology that implements the phase differences between the required electric and magnetic coupling coefficients over minimum through-line length can be designed for the chosen resonator technology. FIG. 6B is a diagram showing an exemplary expansion based on the source and load nodes of the coupling routing diagram of FIG. 6A that more clearly shows the phase relationships between the coupling values.

7. Exemplary Implementations

Figure 7:
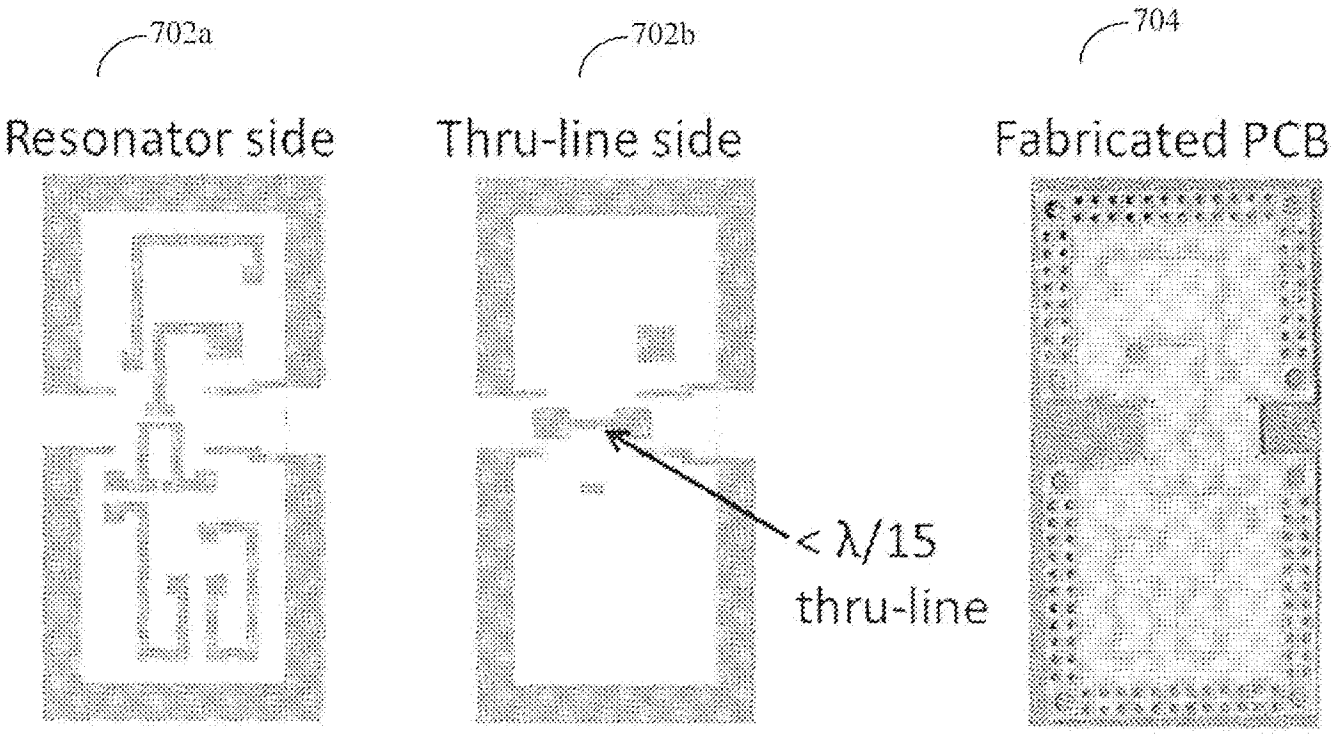
FIG. 7 is a diagram showing models and a photograph of a fabricated circuit board in accordance with an embodiment of the present disclosure.
Figure 8:
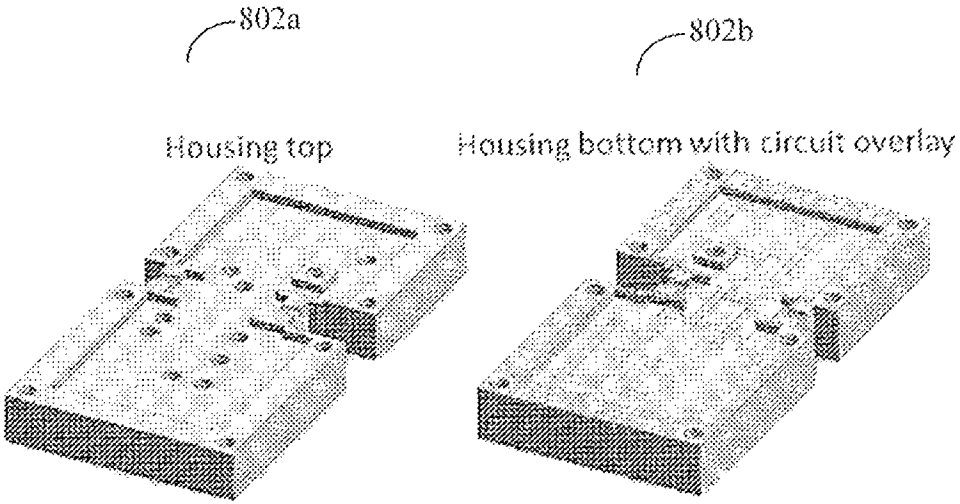
FIG. 8 is a diagram showing models of exemplary housing in accordance with an embodiment of the present disclosure.

FIG. 7 is a diagram showing models 702 and a photograph 704 of a fabricated circuit board in accordance with an embodiment of the present disclosure. In an embodiment, the center frequency of the filter is 3 GHz, and it uses a 5th-order 30-dB equi-ripple elliptic response for high selectivity. The circuit board fits between two sides of a metal housing to produce a suspended stripline circuit. FIG. 8 is a diagram showing models 802 of the housing. This embodiment of the present disclosure allows this filter to have a through line length that is less than one fifteenth of a wavelength while producing a 5th -order bandstop response. A conventional 5th-order bandstop filter would require a through line length of one wavelength. This significant difference allows a filter designed in accordance with an embodiment of the present disclosure to have a substantially reduced physical size relative to conventional designs. It also enables the design of bandstop filters with extremely low passband insertion loss. For example, a filter designed in accordance with an embodiment of the present disclosure has less than 0.1 dB passband insertion loss across S band away from its 30 dB equi-ripple notch.

8. Conclusion

It is to be appreciated that the Detailed Description, and not the Abstract, is intended to be used to interpret the claims. The Abstract may set forth one or more but not all exemplary embodiments of the present disclosure as contemplated by the inventor(s), and thus, is not intended to limit the present disclosure and the appended claims in any way.

The present disclosure has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the disclosure that others can, by applying knowledge within the skill of the art, readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

Any representative signal processing functions described herein can be implemented using computer processors, computer logic, application specific integrated circuits (ASIC), digital signal processors, etc., as will be understood by those skilled in the art based on the discussion given herein. Accordingly, any processor that performs the signal processing functions described herein is within the scope and spirit of the present disclosure.

The above systems and methods may be implemented as a computer program executing on a machine, as a computer program product, or as a tangible and/or non-transitory computer-readable medium having stored instructions. For example, the functions described herein could be embodied by computer program instructions that are executed by a computer processor or any one of the hardware devices listed above. The computer program instructions cause the processor to perform the signal processing functions described herein. The computer program instructions (e.g., software) can be stored in a tangible non-transitory computer usable medium, computer program medium, or any storage medium that can be accessed by a computer or processor. Such media include a memory device such as a RAM or ROM, or other type of computer storage medium such as a computer disk or CD ROM. Accordingly, any tangible non-transitory computer storage medium having computer program code that cause a processor to perform the signal processing functions described herein are within the scope and spirit of the present disclosure.

While various embodiments of the present disclosure have been described above, it should be understood that they have been presented by way of example only, and not limitation. It will be apparent to persons skilled in the relevant art that various changes in form and detail can be made therein without departing from the spirit and scope of the disclosure. Thus, the breadth and scope of the present disclosure should not be limited by any of the above-described exemplary embodiments.

What is claimed is:

1. A filter, comprising:

a first resonator electrically and magnetically coupled, according to a first coupling ratio, to a transmission line of the filter at a first single connection point; and a second resonator electrically and magnetically coupled, according to a second coupling ratio, to the transmission line via a second single connection point, wherein the first ratio, the second ratio, and a physical length of the transmission line between the first resonator and the second resonator are configured to reduce the physical length to less than λ/4.

2. The filter of claim 1, wherein the first ratio and the second ratio are configured based on a phase offset due to the physical length and an electrical phase offset of a coupling reference plane between the first resonator and the second resonator.

3. The filter of claim 1, wherein the physical length between the first resonator and the second resonator is λ/8, and wherein the first resonator implements a λ/8 electrical shift of a coupling reference plane between the first resonator and the second resonator.

4. The filter of claim 3, further comprising:

a third resonator electrically and magnetically coupled to the transmission line, wherein a second λ/8 physical length is present between the second resonator and the third resonator; and a fourth resonator electrically and magnetically coupled to the transmission line, wherein a third λ/8 physical length is present between the third resonator and the fourth resonator.

5. The filter of claim 3, wherein the first ratio and the second ratio are configured such that a composite λ/4 inverter exists between the first resonator and the second resonator.

6. The filter of claim 5, wherein the λ/4 inverter exists based on a λ/8 phase offset due to the physical length and a λ/8 electrical phase offset of a coupling reference plane between the first resonator and the second resonator.

7. The filter of claim 1, wherein the first ratio and the second ratio are configured such that a total through-line length between an input and an output of the filter is equal to the physical length of the filter regardless of an order of the filter.

8. The filter of claim 1, wherein the first ratio and the second ratio are configured such that even and odd mode admittances of the filter are used in a reflection mode topology based on the filter.

9. The filter of claim 1, wherein the first single connection point is collocated with the second single connection point.

10. The filter of claim 1, wherein the first ratio, the second ratio, and the physical length are configured to reduce the physical length to less than λ/4 while maintaining a symmetric notch response of the filter.

11. The filter of claim 1, further comprising:

a third resonator electrically and magnetically coupled, according to a third coupling ratio, to an output of the transmission line at a third single connection point, wherein the first single connection point is located at an input of the transmission line.

12. The filter of claim 1, wherein the first ratio, the second ratio, and the physical length of the transmission line are configured to minimize the physical length to approximately zero.

13. A filter including a plurality of resonators, the resonators comprising:

a first resonator electrically and magnetically coupled, according to a first ratio of electric to magnetic coupling, to an input of a transmission line of the filter a first single connection point; and N additional resonators electrically and magnetically coupled, according to respective additional ratios of electric to magnetic coupling, to the transmission line via N respective single connection points, wherein the first ratio, the respective additional ratios, and respective physical lengths of the transmission line between each resonator in the plurality of resonators are configured to reduce a total through-line length between the input and an output of the filter to a length less than λ/8 times a number of resonators in the plurality of resonators.

14. The filter of claim 13, wherein the first ratio and the respective additional ratios are configured to minimize corresponding physical lengths between each of the resonators.

15. The filter of claim 13, wherein the first ratio and the respective additional ratios are configured based on respective phase offsets due to the physical length and respective electrical phase offsets of coupling reference planes between respective resonators in the plurality of resonators.

16. The filter of claim 13, wherein the first ratio and the respective additional ratios are configured such that even and odd mode admittances of the filter are used in a reflection mode topology based on the filter.

17. A filter including a plurality of resonators, the resonators comprising:

a first resonator electrically and magnetically coupled to an input of a transmission line according to a first ratio of electric to magnetic coupling;

a second resonator electrically and magnetically coupled to the transmission line according to a second ratio of electric to magnetic coupling;

a third resonator electrically and magnetically coupled to the transmission line according to a third ratio of electric to magnetic coupling;

a fourth resonator electrically and magnetically coupled to the transmission line according to a fourth ratio of electric to magnetic coupling; and a fifth resonator electrically and magnetically coupled to an output of the transmission line according to a fifth ratio of electric to magnetic coupling, wherein the first ratio, the second ratio, the third ratio, the fourth ratio, and the fifth ratio are configured such that a total through-line length between the input and the output of the filter is reduced to a length less than λ/8 times a total number of resonators in the filter.

18. The filter of claim 17, wherein the first ratio, the second ratio, the third ratio, the fourth ratio, and the fifth ratio are configured to minimize a physical length between each of the resonators.

19. The filter of claim 17, wherein the first ratio, the second ratio, the third ratio, the fourth ratio, and the fifth ratio are configured based on respective phase offsets due to the physical length and respective electrical phase offsets of coupling reference planes between respective resonators in the plurality of resonators.

20. The filter of claim 17, wherein the first ratio, the second ratio, the third ratio, the fourth ratio, and the fifth ratio are configured such that even and odd mode admittances of the filter are used in a reflection mode topology based on the filter.

* * * * *